US008777658B2

(12) United States Patent
Holland et al.

(10) Patent No.: US 8,777,658 B2
(45) Date of Patent: Jul. 15, 2014

(54) INGRESS REDUCTION COAXIAL CABLE CONNECTOR

(75) Inventors: Michael Holland, Santa Barbara, CA (US); Reed Gibson, Ventura, CA (US)

(73) Assignee: Holland Electronics, LLC, Ventura, CA (US)

( * ) Notice: Subject to any disclaimer, the term of this patent is extended or adjusted under 35 U.S.C. 154(b) by 206 days.

(21) Appl. No.: 13/489,406

(22) Filed: Jun. 5, 2012

(65) Prior Publication Data

US 2013/0244481 A1 Sep. 19, 2013

Related U.S. Application Data

(60) Provisional application No. 61/612,922, filed on Mar. 19, 2012.

(51) Int. Cl.
*H01R 9/05* (2006.01)

(52) U.S. Cl.
USPC ..... 439/578

(58) Field of Classification Search
USPC ..... 439/578, 63, 584–585, 188, 583, 581, 439/620.03, 944
See application file for complete search history.

(56) References Cited

U.S. PATENT DOCUMENTS

| | | | | |
|---|---|---|---|---|
| 4,660,921 | A | 4/1987 | Hauver | |
| 5,601,491 | A | 2/1997 | Chan et al. | |
| 5,632,637 | A | 5/1997 | Diener | |
| 5,775,927 | A | 7/1998 | Wider | |
| 5,857,861 | A | 1/1999 | Silliman | |
| 5,921,793 | A | 7/1999 | Phillips | |
| 6,106,314 | A | 8/2000 | McLean et al. | |
| 6,270,367 | B1 | 8/2001 | Bussard | |
| 6,309,251 | B1 | 10/2001 | Tang | |
| 6,398,568 | B1 | 6/2002 | Preece et al. | |
| 6,572,405 | B2 * | 6/2003 | Lin et al. | 439/578 |
| 6,872,091 | B2 * | 3/2005 | Huang | 439/578 |
| 7,168,980 | B2 * | 1/2007 | Peng | 439/580 |
| 7,416,444 | B1 | 8/2008 | Lin | |
| 8,172,617 | B2 * | 5/2012 | Peng | 439/620.03 |
| 2003/0063032 | A1 * | 4/2003 | Usui et al. | 343/700 MS |
| 2007/0264853 | A1 | 11/2007 | Gonzales et al. | |
| 2008/0057782 | A1 | 3/2008 | Berthet et al. | |
| 2008/0265219 | A1 * | 10/2008 | Whitehead et al. | 252/511 |
| 2010/0221940 | A1 | 9/2010 | Hoyack et al. | |

* cited by examiner

*Primary Examiner* — Jean F Duverne
(74) *Attorney, Agent, or Firm* — Paul D. Chancellor; Ocean Law

(57) ABSTRACT

A coaxial connector including a selectively engageable radio frequency interference shield.

19 Claims, 18 Drawing Sheets

INGRESS REDUCTION COAXIAL CABLE CONNECTOR

PRIORITY CLAIM

This application claims the benefit of U.S. Prov. Pat. App. No. 61/612,922 filed Mar. 19, 2012 and entitled SHIELDED COAXIAL CONNECTOR.

BACKGROUND OF THE INVENTION

1. Field of the Invention

The invention relates to the field of manufactured radio frequency devices. More particularly, the present invention relates to a radio frequency shield for use in association with a coaxial cable connector.

2. Discussion of the Related Art

In cable television and satellite television systems ("CATV") reduction of interfering radio frequency ("RF") signals improves signal to noise ratio and helps to avoid saturated reverse amplifiers and related optic transmission that is a source of distortion.

Past efforts have limited the ingress of interfering RF signals into CATV systems. These efforts have included increased use of traditional connector shielding, multi-braid coaxial cables, connection tightening guidelines, increased use of traditional splitter case shielding, and high pass filters to limit low frequency spectrum interfering signal ingress in active home CATV systems.

While it appears the industry accepts the status quo as satisfactory, there remain, in the inventor's view, good reasons to develop improvements further limiting the ingress of interfering RF signals into CATV systems.

One significant location of unwanted RF signal and noise ingress is in the home. This occurs where the subscriber leaves a CATV connection such as a wall-mounted connector or coaxial cable drop connector disconnected/open. An open connector end exposes a normally metallically enclosed and shielded signal conductor and can be a major source of unwanted RF ingress.

The F connector is the standard connection used for cable television and satellite signals in the home. For example, in the home one will typically find a wall mounted female F connector or a coaxial cable "drop" including a male F connector for supplying a signal to the TV set, cable set-top box, or internet modem. Notably, wall mounted female F connectors are connected via a coaxial cable terminated with male connectors at opposite ends.

Whether a CATV signal is supplied to a room via a drop cable or via a wall mounted connector, each one is a potential source of unwanted RF signal ingress. Wall mounted connectors can be left open or a coaxial cable attached to the wall mounted connector can be left open at one end. Similarly, drop cables terminated with a male F connector can be left open.

Multiple CATV connections in a home increase the likelihood that some connections will be left unused and open, making them a source of unwanted RF ingress. And, when subscribers move out of a home, CATV connections are typically left open, another situation that invites RF ingress in a CATV distribution system.

A method of eliminating unwanted RF ingress in a CATV system is to place a metal cap over each unused F connector in the home or, to place a single metallic cap over the feeder F port at the home network box. But, the usual case is that all home CATV connections are left active and open, a practice the industry accepts to avoid expensive service calls associated with new tenants and/or providing the CATV signal in additional rooms.

The inventor's experience shows current solutions for reducing unwanted RF ingress resulting from open connectors are not successful and/or not widely used. Therefore, to the extent the CATV industry recognizes a need to further limit interfering RF ingress into CATV systems, it is desirable to have connectors that reduce RF ingress when they are left open.

SUMMARY OF THE INVENTION

An inventive coaxial connector includes means for one or more of shielding against RF ingress and guarding against electrical hazards. In various embodiments, the inventive connector includes movable part internals and in various embodiments connector internals provide a disconnect switch such as a series disconnect switch.

Various male connector embodiments and various female connector embodiments provide RF signal ingress protection when a connector is left open. Enhanced shielding is activated when the connector end is left open and de-activated when a mating connector is engaged.

In some female embodiments, a spring loaded nose such as an insulator passes through a connector body end for operating a disconnect switch within the body. In an open position, two center conductor contacts of the shielded connector are separated. This open circuit restricts RF signals from passing through the shielded connector. When a mating connector is engaged, the spring loaded insulator is pushed into the shielded connector body causing center conductor contacts to engage for passing RF signals. In the open position, where the center conductor is disconnected, RF signals received at the entry (open) end are restricted from passing through to connected systems such as CATV systems due to the open center conductor.

In some male embodiments with a pin type contact, the pin is fixed in a movable contact assembly that is biased away from a coaxial cable center conductor by a spring. Protruding from a body end and typically encircled by a fastener engaging the same body end, the pin is movable for engaging a movable contact of the movable contact assembly with the coaxial cable center conductor. When a mating connector is engaged, the spring loaded pin is pushed further into the body where it, and/or the movable contact, engages the center conductor of the coaxial cable to complete the center conductor circuit.

And, in some embodiments, a similar mechanical activation method is used to operate a shield curtain surrounding a center contact of the disconnected connector end. In a shield curtain embodiment, positioning and opening shield curtain slots is optimized to reduce passing signals for the most damaging spectrum bands such as the CATV data upstream spectrum of 5-42 MHz.

BRIEF DESCRIPTION OF THE DRAWINGS

Prior Art

Exemplary Embodiments of Present Invention

Figure 8A:
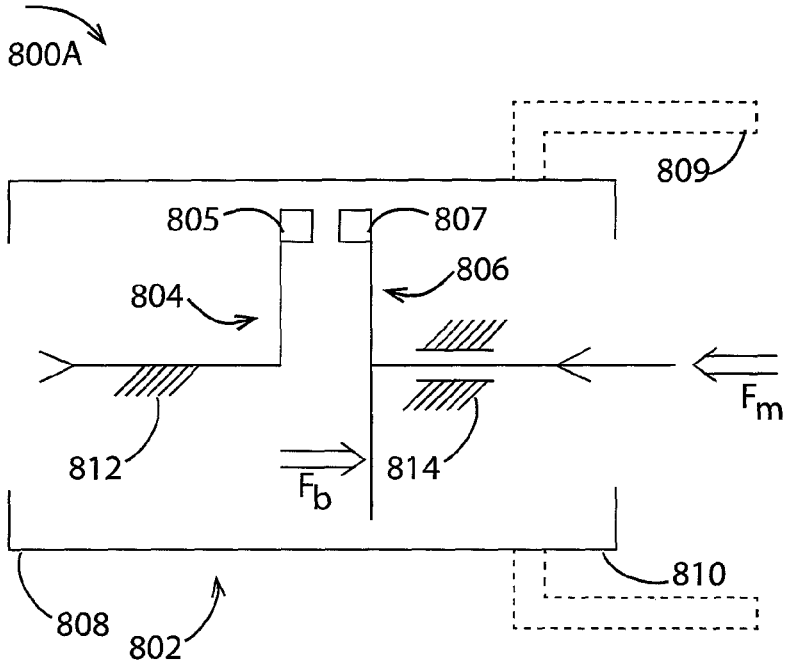
Figure 8B:
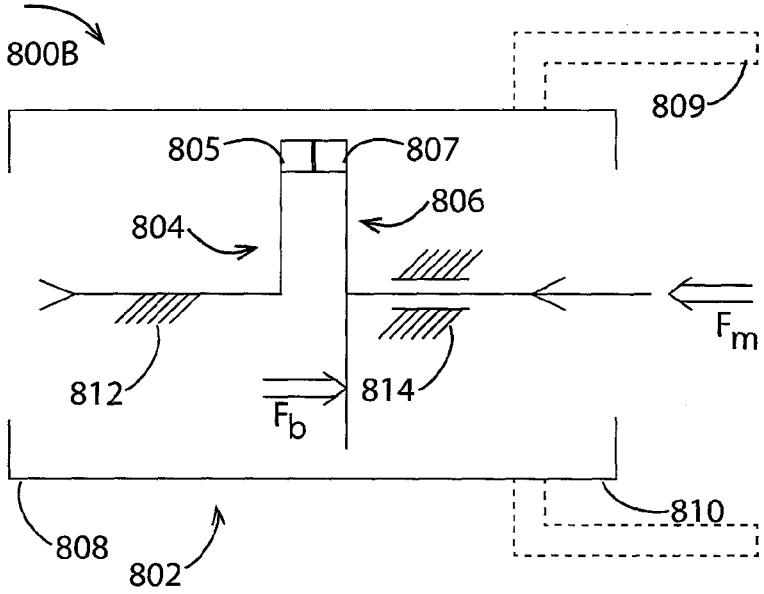

FIGS. 8A and 8B are schematic representations of a shielded coaxial connector in accordance with an embodiment of the present invention.

Figure 9A:
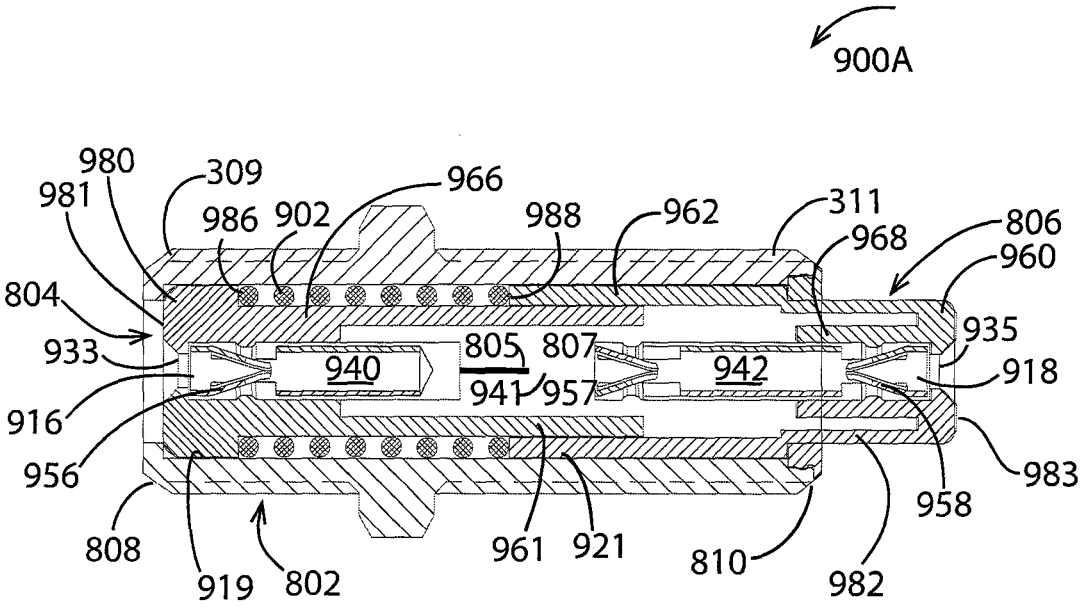
Figure 9B:
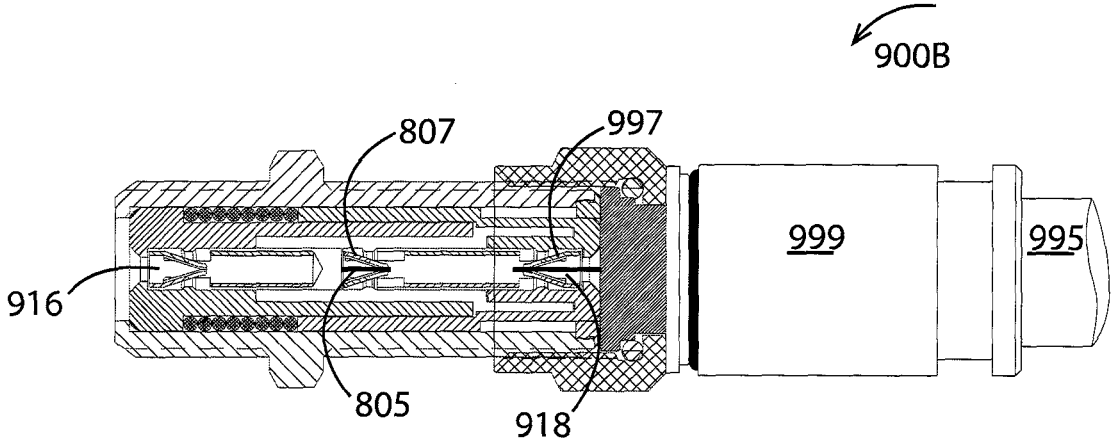

FIGS. 9A and 9B are cross-sectional representations of a coaxial splice connector in accordance with an embodiment of the present invention.

Figure 10A:
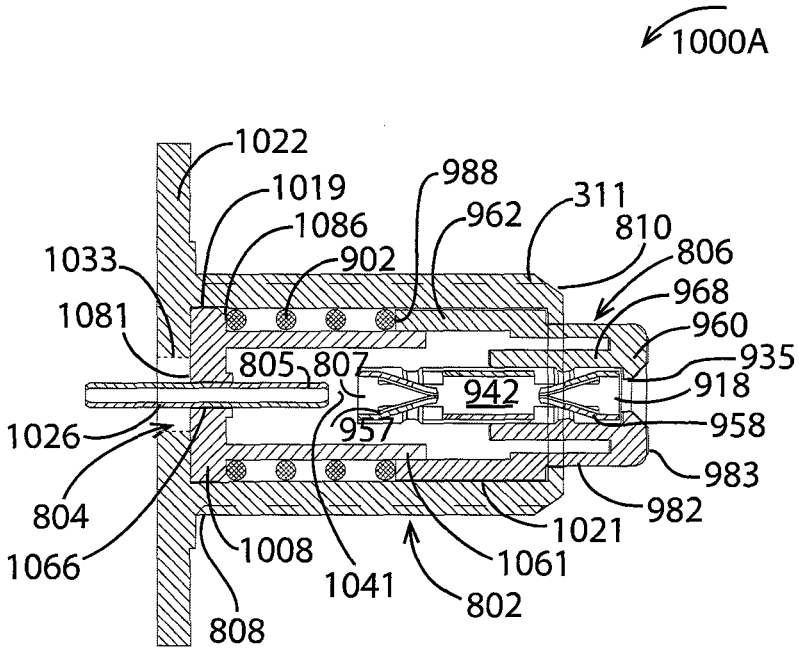
Figure 10B:
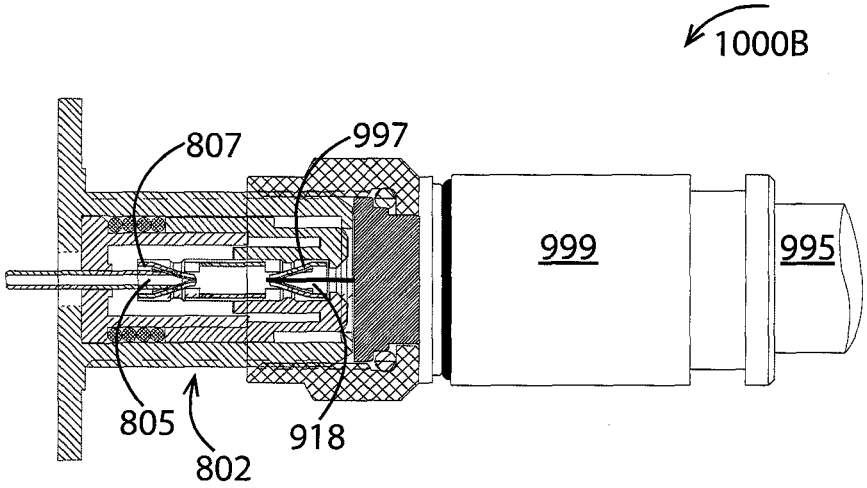

FIGS. 10A and 10B are cross-sectional representations of a coaxial bulkhead connector in accordance with an embodiment of the present invention.

Figure 11A:
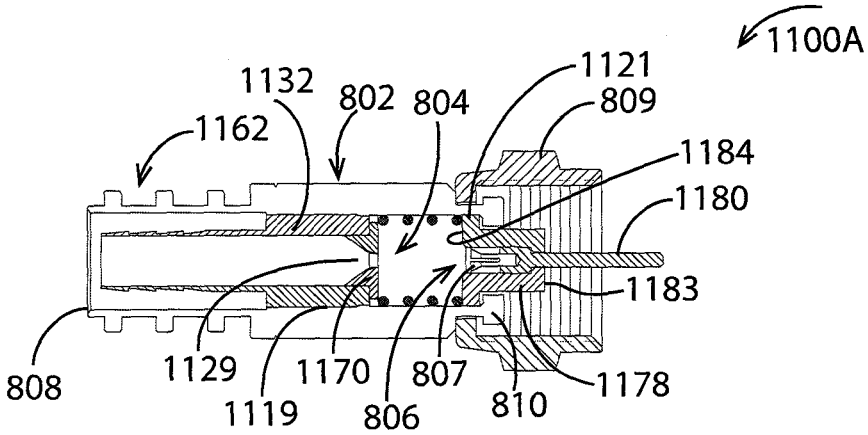
Figure 11B:
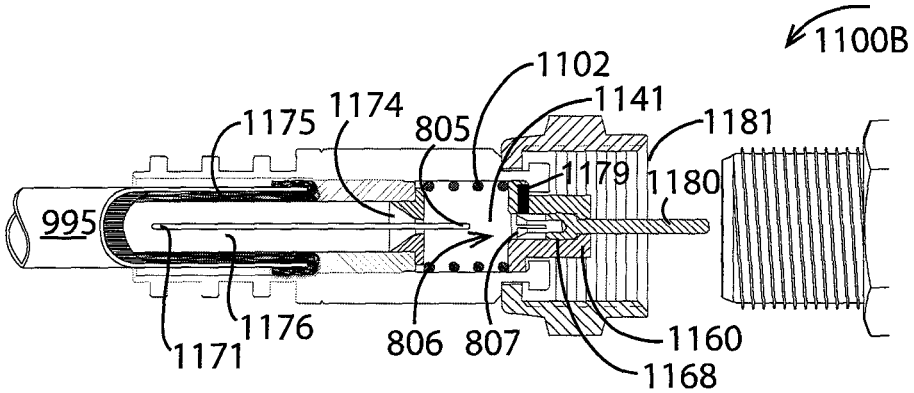
Figure 11C:
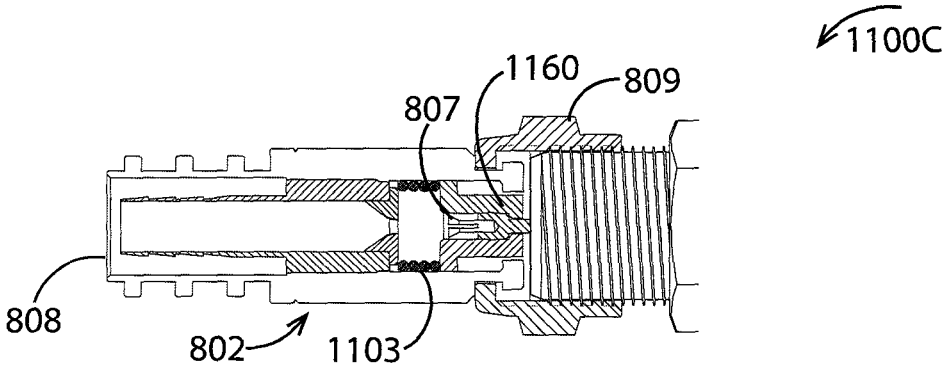

FIGS. 11A, 11B, and 11C are cross-sectional representations of a male coaxial connector in accordance with an embodiment of the present invention.

Figure 12:
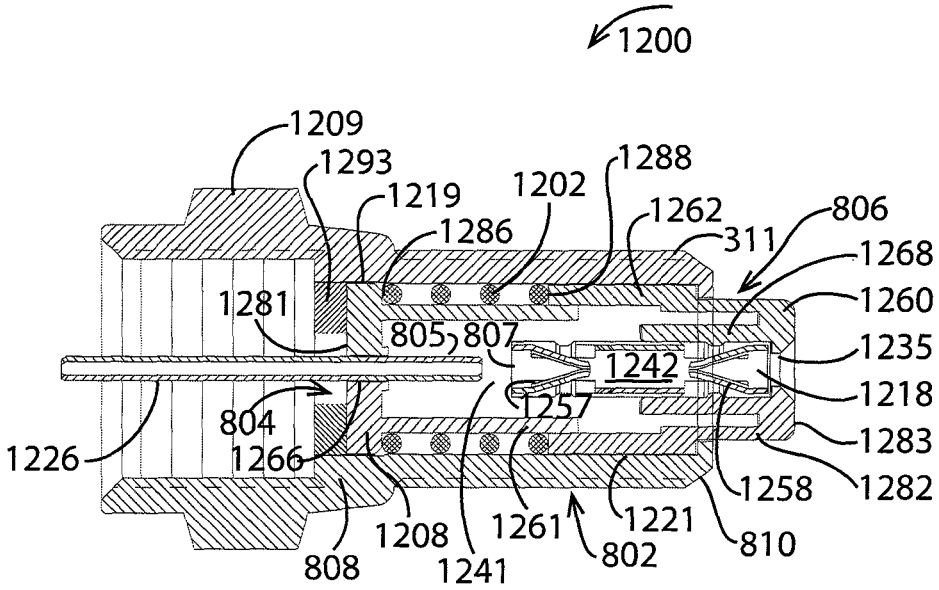

FIG. 12 is a cross-sectional representation of a coaxial adapter connector in accordance with an embodiment of the present invention.

Figure 13A:
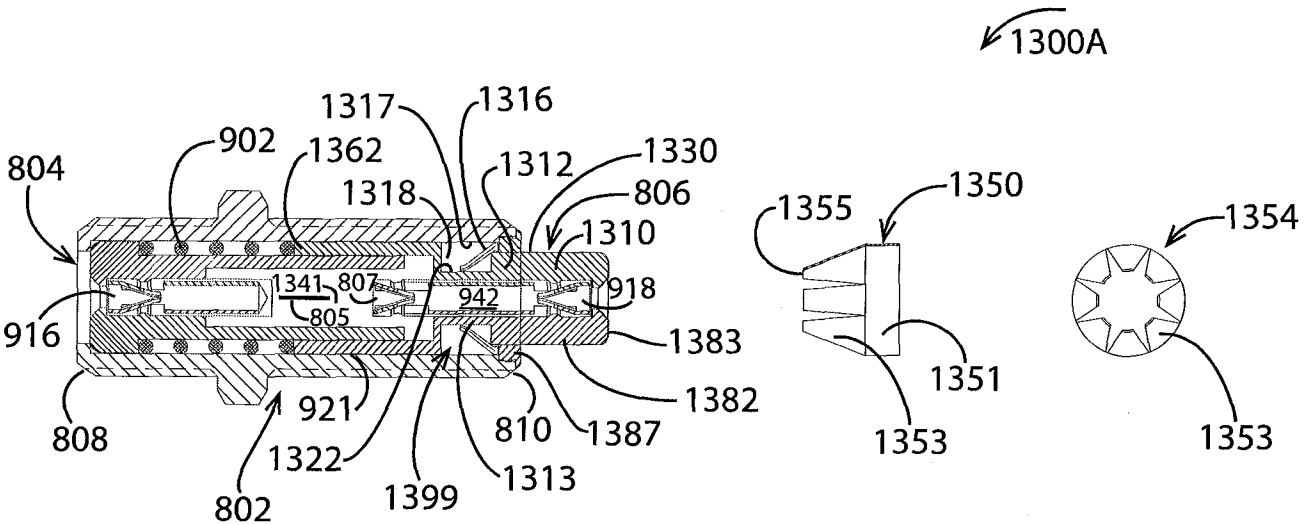
Figure 13B:
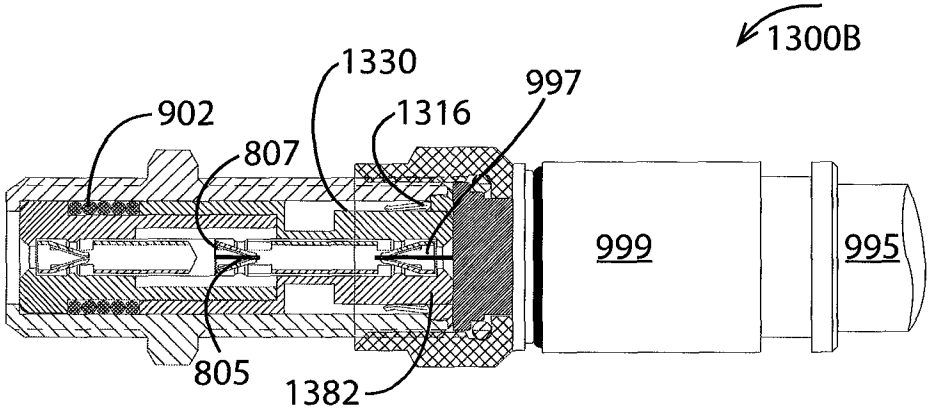

FIGS. 13A and 13B are cross-sectional representations of a second coaxial splice connector in accordance with an embodiment of the present invention.

Figure 14A:
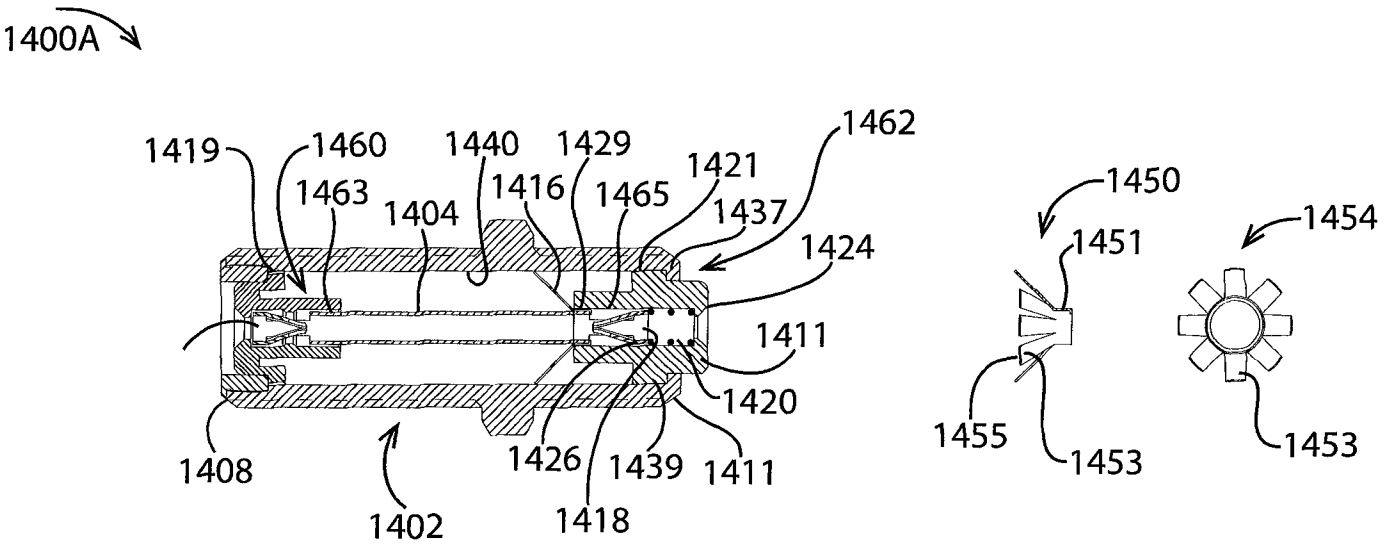
Figure 14B:
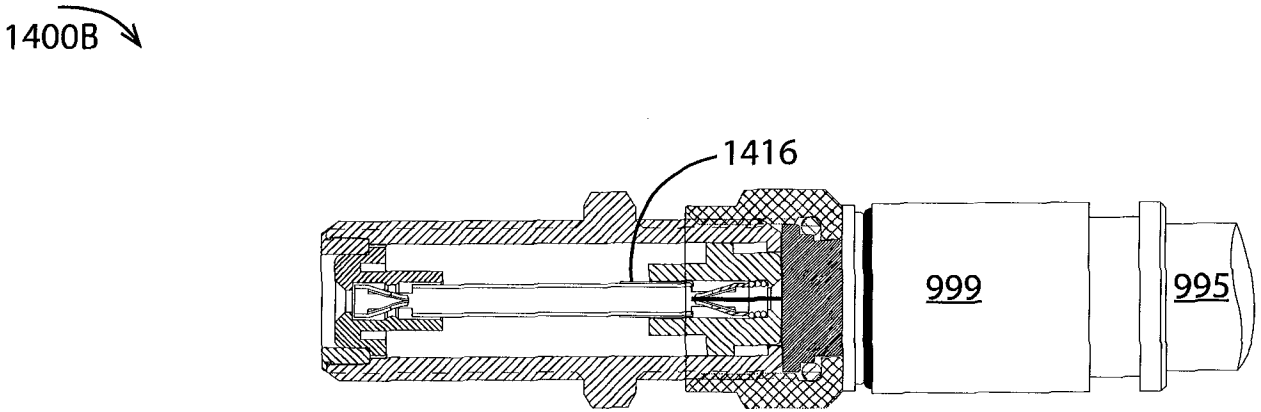

FIGS. 14A and 14B are cross-sectional representations of a third coaxial splice connector in accordance with an embodiment of the present invention.

Figure 14C:
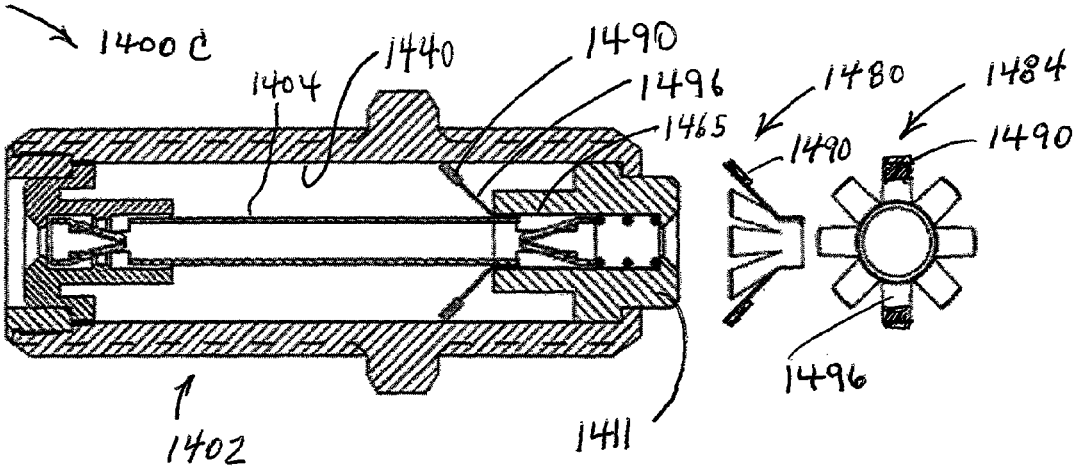
Figure 14D:
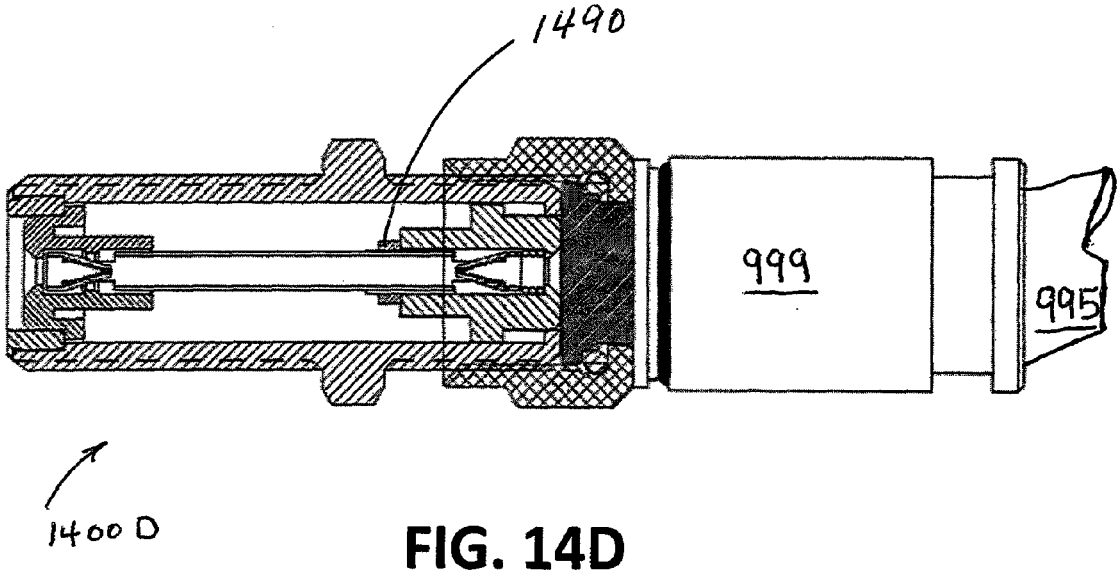

FIGS. 14C and 14D are cross-sectional representations of a fourth coaxial splice connector in accordance with an embodiment of the present invention.

Figure 15:
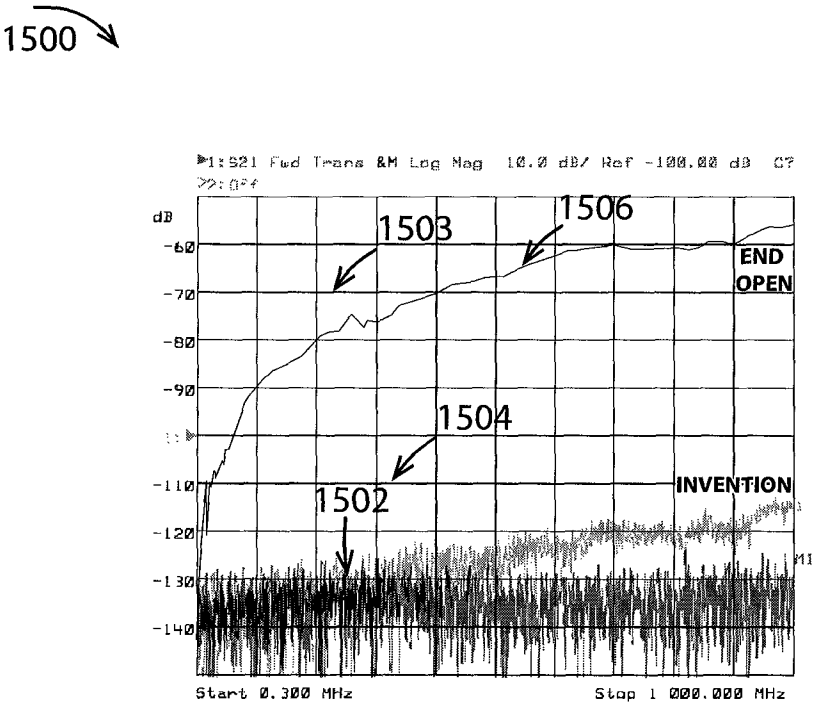

FIG. 15 indicates comparative performance of selected connectors.

Figure 16:
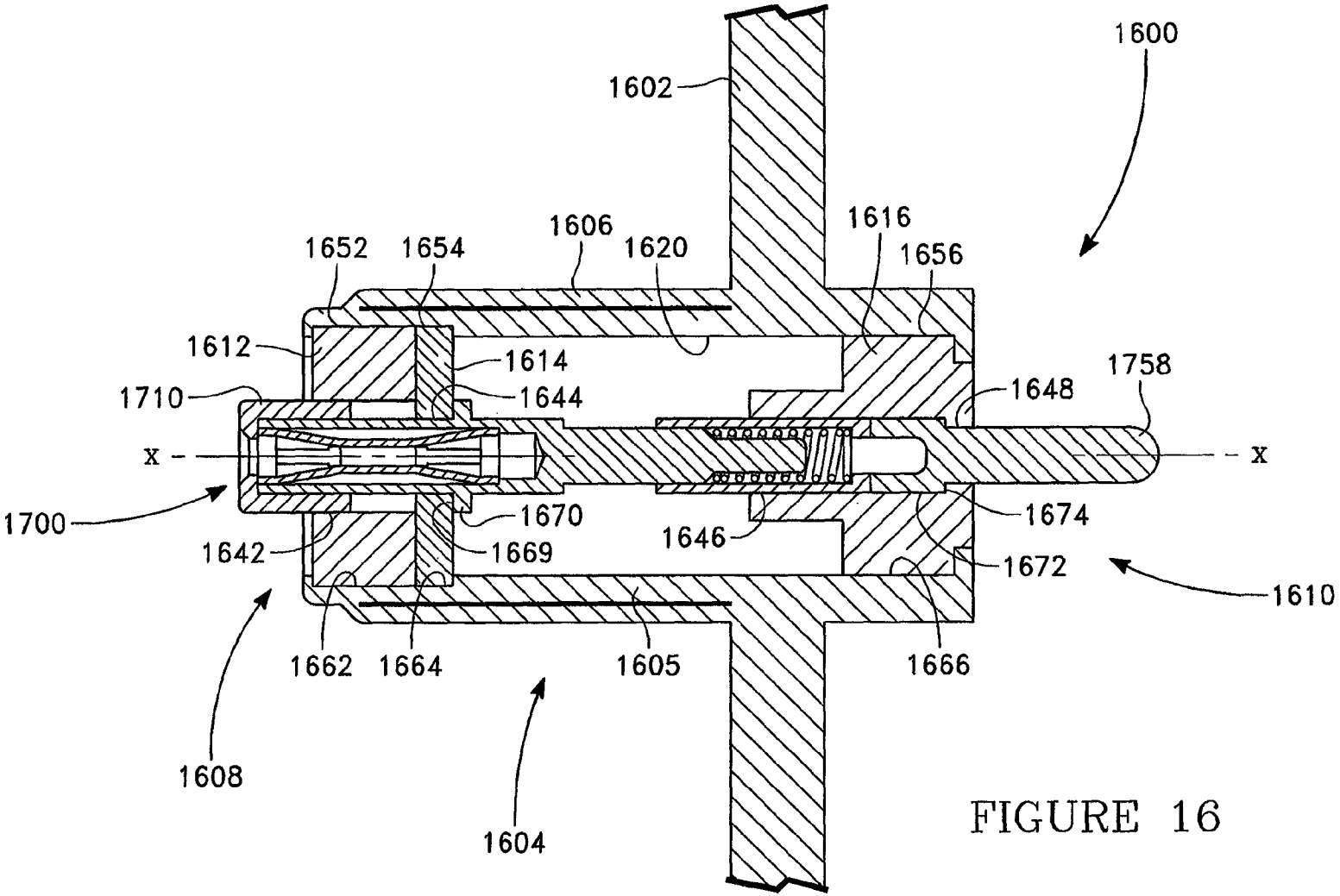
Figure 17:
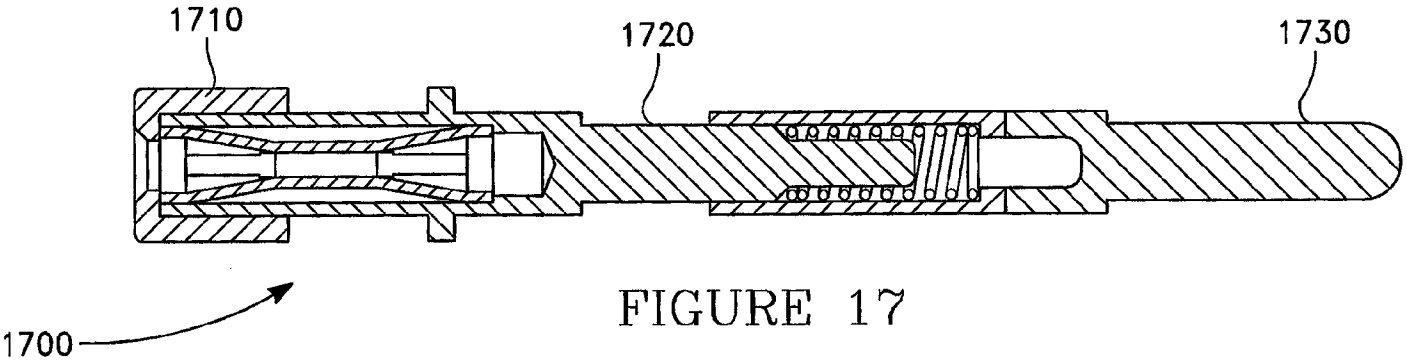
Figure 18:
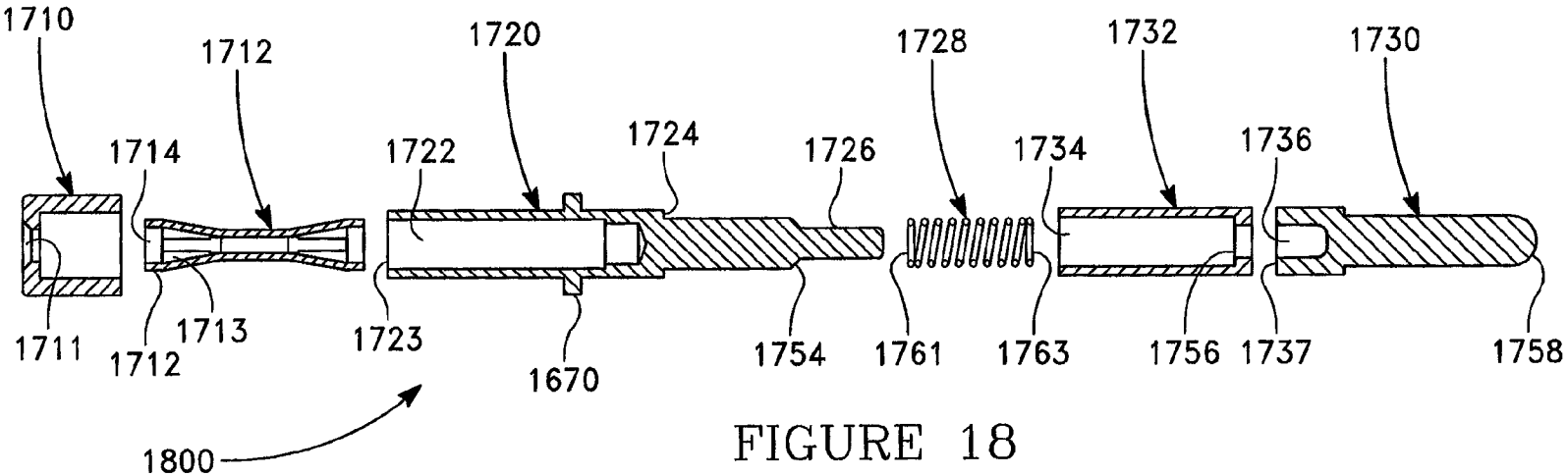

FIGS. 16-18 are cross-sectional representations of a female coaxial connector in accordance with an embodiment of the present invention.

DETAILED DESCRIPTION OF THE PREFERRED EMBODIMENTS

The disclosure provided in the following pages describes examples of some embodiments of the invention. The designs, figures, and description are non-limiting examples of the embodiments they disclose. For example, other embodiments of the disclosed device and/or method may or may not include the features described herein. Moreover, disclosed advantages and benefits may apply to only certain embodiments of the invention and should not be used to limit the disclosed invention.

As used herein, the term "coupled" includes direct and indirect connections. Moreover, where first and second devices are coupled, intervening devices including active devices may be located therebetween.

Figure 2:
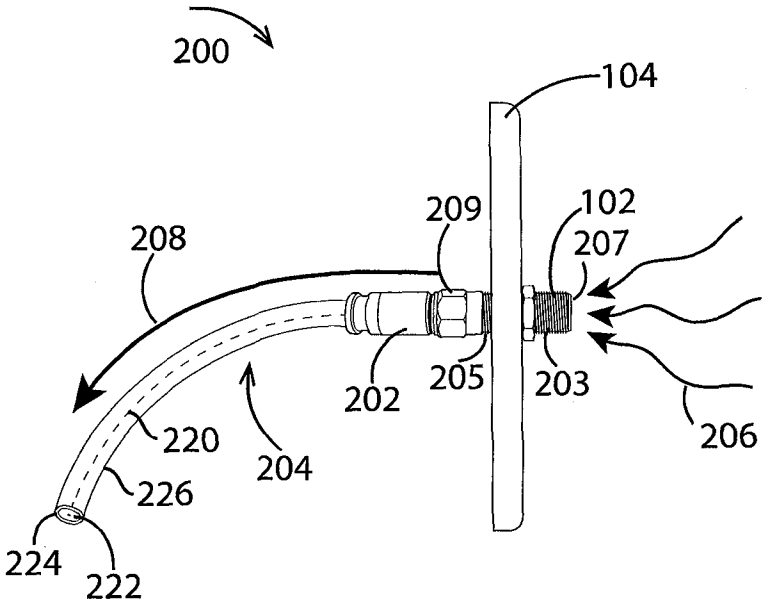
Figure 2 Prior Art
FIG. 2 shows a prior art CATV wall plate that is a source of ingress of interfering RF signals.
Figure 1:
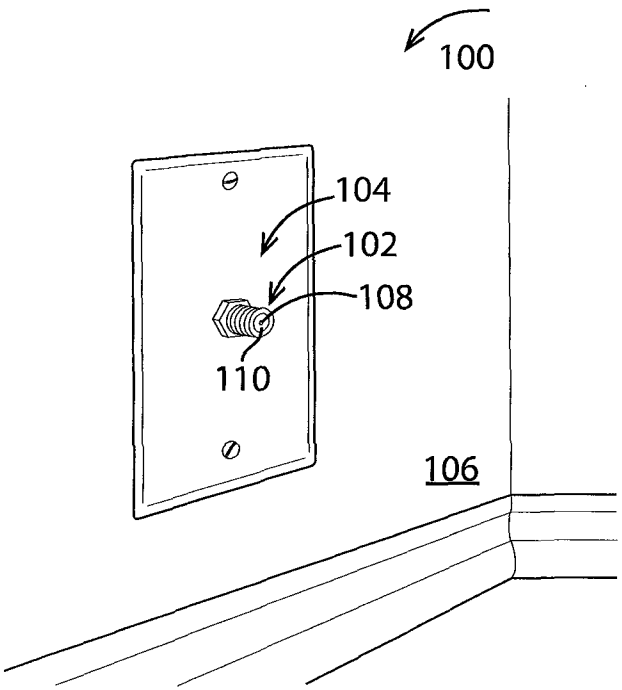
Figure 1 Prior Art
FIG. 1 shows a prior art CATV wall plate with an F female connector or a splitter connector with a mated F female connector.
Figure 3A:
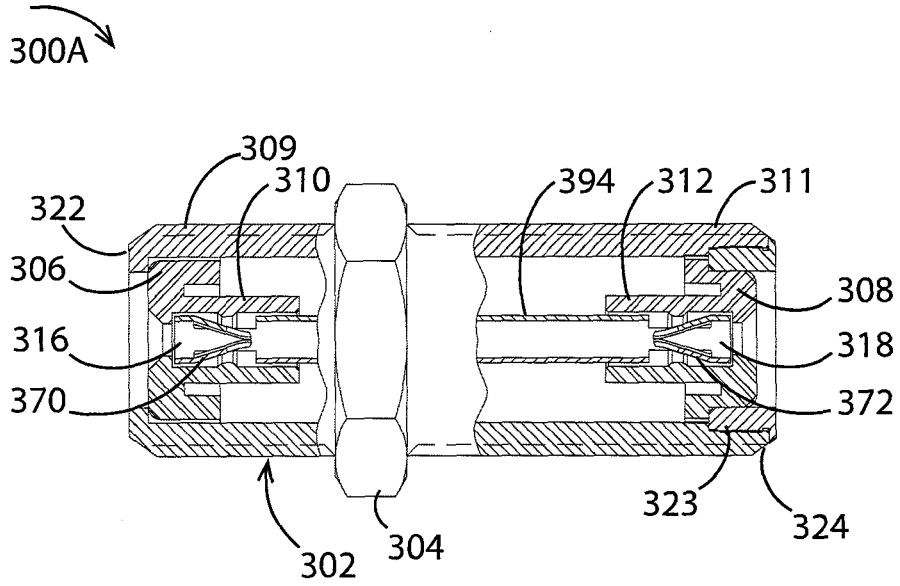
Figure 3A Prior Art
FIGS. 3A and 3B show a prior art standard F female splice (commonly called F-81) with F contacts on both ends.
Figure 3B:
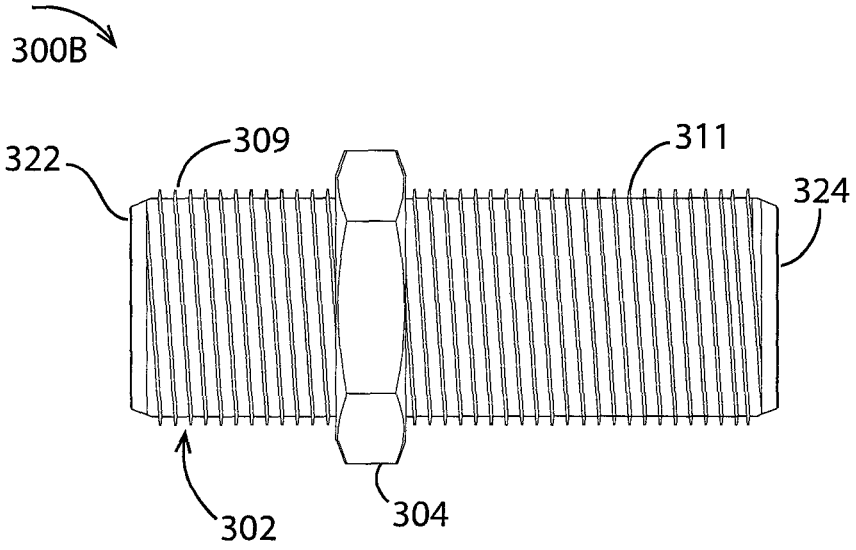
Figure 3B Prior Art
Figure 4:
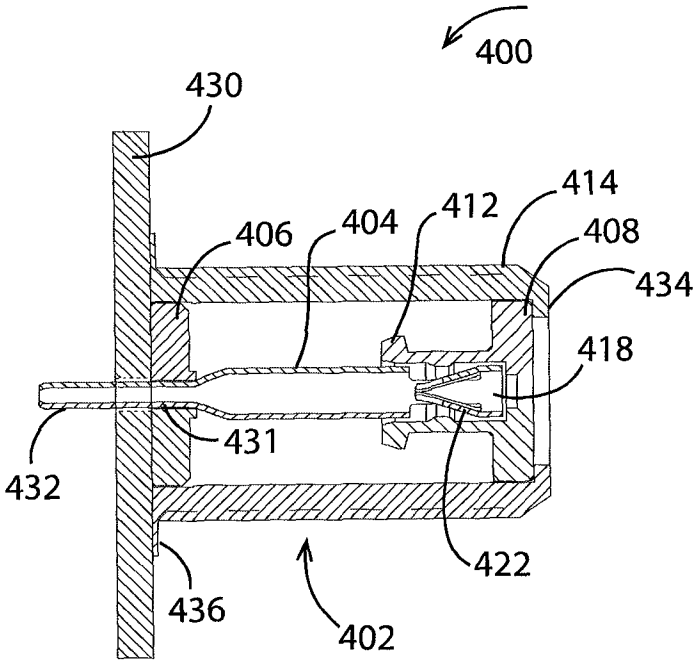
Figure 4 Prior Art
FIG. 4 shows a prior art standard F female bulkhead coaxial connector (commonly called an F-61).
Figure 5:
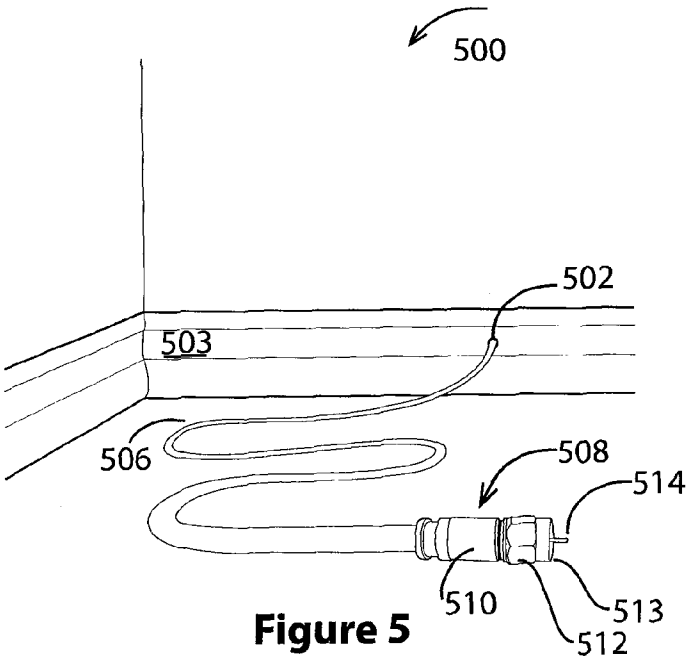
Figure 5 Prior Art
FIG. 5 shows a prior art CATV installation having a cable terminated with a male F connector.

FIGS. 1-7 show prior art devices. Typical prior art CATV signal outlets are shown in FIGS. 1, 2, and 5 and typical coaxial cable connectors are shown in FIGS. 3, 4, 6, and 7.

FIG. 1 shows a front view of a wall mounted coaxial connector 100. The connector 102 is mounted on a wall plate 104 fixed to a room wall 106. As shown, the connector is a female F connector. A hole 108 in an insulator 110 of the connector 102 provides access to a CATV signal conductor 304 (see FIG. 3) within the connector.

FIG. 2 shows a side view of FIG. 1's wall mounted coaxial connector 200. Here, the female F connector 102 is shown as a female-female connector for splicing coaxial cable. Threads at opposed ends of the connector 203, 205 provide a means for attaching male F connectors to opposed splice ends 207, 209. A coaxial cable for carrying a CATV signal 204 is terminated with a male F connector 202 that threadingly engages an end 209 of the splice.

Typical coaxial cable features will be known to persons of ordinary skill in the art. For example, an embodiment includes a center conductor 220 surrounded by a dielectric material 222, the dielectric material being surrounded in turn by one or two shields 224 such as a metallic foil wrapped in a metallic braid. An outer insulative jacket 226 such as a polyvinylchloride jacket encloses the conductors.

As seen, the open end of the splice 207 provides an opportunity for unwanted RF ingress 208. In particular, unwanted RF ingress 206 is shown entering an exposed end of the splice 207 where it is conducted by a CATV signal conductor 304 through the connector and to a signal conductor 220 of the attached CATV coaxial cable.

FIG. 3A shows a cross-section of a splice 300A and FIG. 3B shows a side view of the splice of same splice 300B. Referring to both of the FIGS., the splice includes a cylindrical outer body 302 with a circumferential, hexagonal grip 304 between opposed first and second ends 322, 324 of the splice. Outer surfaces of the body are threaded, in particular, an outer surface between the first end and the grip ring is threaded 309 and an outer surface between the second end and the grip ring is threaded 311.

Within and at opposed ends of the cylindrical body 304 are insulators 306, 308, each having a central socket 310, 312 for receiving opposed ends 316, 318 of a tubular seizing pin 304. Resilient tines located in each end of the seizing pin 370, 372 provide a means for making a secure electrical contact with a conductor (not shown) inserted in either end of the seizing pin. Splice internals are typically fixed in place by rolling an end of the body 324. In some embodiments, rolling a body end 324 or an interference fit fixes an annular plug 323 adjacent to the second end insulator 312.

FIG. 4 shows a single ended female coaxial cable connector 400. An outer body 402 has front end 434 opposite a rear end 436 and threads on an external surface 414. The body also houses a front insulator 408 with a socket 412 for receiving a front end 418 of a tubular seizing pin 404. Resilient tines located in the front end of the seizing pin 422 provide a means for making a secure electrical contact with a conductor (not shown). A rear insulator 406 supports a rear portion of the seizing pin 431 while a rearmost portion of the seizing pin 432 passes through a connector base 430 to which the first end of the connector body is fixed. In various embodiments, this type of connector is affixed to larger surfaces such as equipment rear panels.

FIG. 5 shows a coaxial cable "drop" within a room 500. As shown, a hole 502 penetrates a room baseboard 503 and a length of coaxial cable 506 enters the room through the hole. Such "drops" are typically terminated with male F connectors. In particular, a male F connector 508 has an outer shell 510 adjacent to a fastener 512 and a prepared end of the coaxial cable is inserted in the connector such that the central conductor 514 of the coaxial cable protrudes beyond a fastener free end 513.

Figure 6:
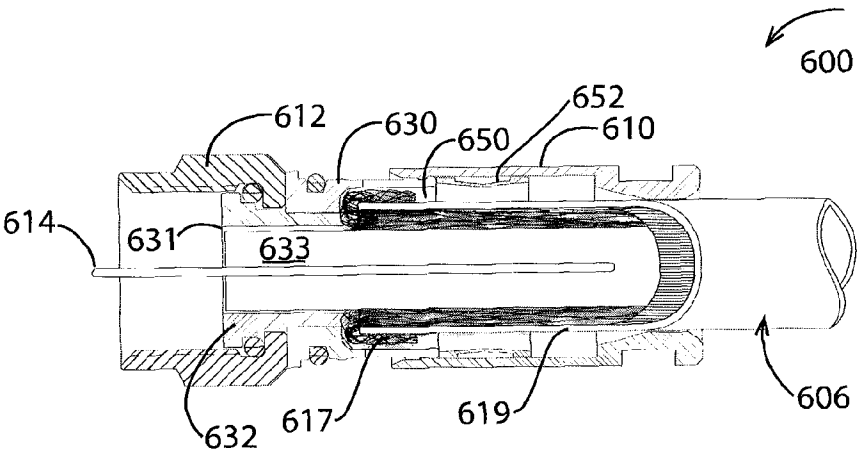
Figure 6 Prior Art
FIG. 6 shows a prior art male F connector with a compression type cable attachment.

FIG. 6 shows a compression type male F connector 600. A connector body 630 arranged concentrically about a post 632 provides an annular cavity 650 for receiving metal braid 617 and jacket 619 of a coaxial cable 606. The body and a fastener 612 are rotatably engaged. Passing through a hollow interior of the post 631 is coaxial cable dielectric 633 and coaxial cable center conductor 614. Cable fixation occurs when a connector outer shell 610 forces a collapsible ring 652 to press against the coaxial cable jacket as the shell is slid toward a fastener 612 of the connector. As persons of ordinary skill in the art will recognize, this FIG. illustrates but one of many F type compression connectors.

Figure 7:
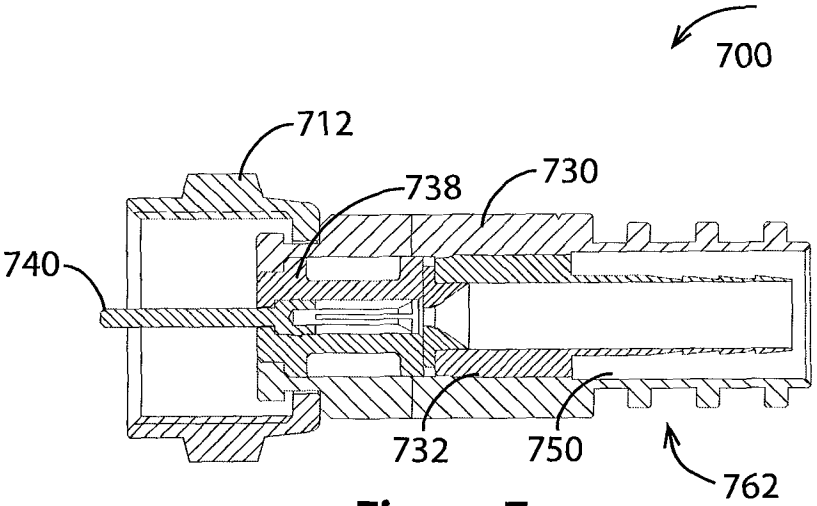
Figure 7 Prior Art
FIG. 7 shows a prior art male F connector with a crimp type cable attachment.

FIG. 7 shows a crimp type male F connector utilizing a fixed pin 700. A connector body 730 arranged concentrically about a post 732 provides an annular cavity 750 for receiving metal braid and jacket of a coaxial cable (not shown). An insulator 738 inserted in the body supports a center contact pin 740 and a fastener 712 rotatably engages the body. Cable fixation occurs when a crimp zone of the connector body 762 is forced against an outer jacket of a coaxial cable (not shown).

FIGS. 8-14 show shielded coaxial connectors in accordance with the present invention. In particular, these connectors incorporate internal movable parts for shielding and/or enhancing connector safety.

FIGS. 8A and 8B show schematic views of a shielded coaxial connector 800A, 800B. The connector includes a tubular body 802 having opposing ends 808, 810, at least one of which is for receiving a mating male or female coaxial cable connector. Some embodiments include a fastener 809 for engaging a female coaxial connector such as a port.

A stationery contact assembly 804 is near a first end of the body 808 and a movable contact assembly 806 is near a second end of the body 810. The stationery contact assembly is at least partially within the body 802 and the movable contact assembly is only partially within the body such that a biasing force Fb acting on the movable contact assembly tends to separate a stationery contact 805 of the stationery contact assembly and a movable contact 807 of the movable contact assembly. In various embodiments, a front support 812 fixedly couples the stationery contact assembly to the body while a rear support enables motion of the movable contact relative to the body. For example, a sliding contact rear support 814 enables the movable contact to slide relative to the body. And, in various embodiments one or both of the front and rear supports provide an electrical insulating barrier between the body 802 and at least one of the contacts 805, 807.

A feature of this connector is seen in FIG. 8B when the biasing force Fb is overcome by a moving force Fm, pushing the movable contact assembly 806 in the direction of the body's first end such that the contacts 805, 807 press together. In various embodiments the moving force is supplied by a coaxial connector that engages the second end of the body 810. Exemplary biasing force means include springs, spring-like materials, gas struts or springs, resilient materials, resilient structures, elastic materials, elastic structures, and the like.

FIGS. 9A and 9B show cross sectional views of a coaxial splice connector 900A, 900B. A connector body 802 having first and second ends 808, 810 houses a stationery contact assembly 804 with a stationery contact 805, and a movable contact assembly 806 with a movable contact 807. A first end bore of the body 919 receives the stationery contact assembly and a second end bore of the body 921 receives the movable contact assembly. In various embodiments the bores 919, 921 have similar or the same diameters and in some embodiments the bore is a through bore.

The stationery contact assembly 804 has a generally tubular shape and is fitted into the first body bore 919. The contact assembly includes a stationery conductor assembly 940 and a stationery conductor assembly carrier 980. As seen, a connector body central conductor incorporates the conductors of the stationery and movable conductor assemblies.

Notably, the word assembly encompasses devices with a plurality of parts and devices with a plurality of features embodied in a single part.

A first end of the carrier 981 is positioned near the first end of the body 808 and a second end of the carrier 961 extends into the body. A socket of the carrier 966 holds the conductor assembly 940. The conductor assembly 940 extends between and includes the stationery contact 805 at one end and an accessible contact 916 with inwardly directed tines 956 at an opposed end. A stationery entrance of the carrier 933 provides access to the accessible contact.

The movable contact assembly 806 has a generally tubular shape and is fitted into the second body bore 921. The movable contact assembly includes a movable conductor assembly 942 and a movable conductor assembly carrier 982.

A first end of the carrier 983 protrudes from the body 802 and a second end of the carrier 962 extends into the body. A socket of the carrier 968 holds the conductor assembly 942. The conductor assembly 942 extends between and includes a) the movable contact 807 at one end with inwardly directed tines 957 and an accessible contact 918 with inwardly directed tines 958 at an opposed end. A movable entrance of the carrier 935 provides access to the accessible contact.

In various embodiments, the movable contact assembly 806 is separated from the stationery contact assembly 804 by a resilient device or material such as a spring. In an embodiment, a coil spring 902 is captured between an end of the movable carrier 988 and fixed surface such as a radial shoulder of the stationery carrier 986. As skilled artisans will recognize, the function of springing the stationery and movable contact assemblies apart can be accomplished in other ways with similar effect. For example, the contact assemblies may interoperate via telescoping arrangement as shown or they may have no such engagement.

A feature of this connector is seen from FIGS. 9A and 9B. In particular, engaging a mating connector 999 with the second end of the splice 810 pushes a protruding nose 960 of the first contact assembly toward the first end of the splice body 802. Moving with the contact assembly is the movable contact 807 which is seen in FIG. 9B to engage the stationery contact 805 by traversing a gap 941. This completes the circuit between the accessible contacts 916 and 918 of the splice. As shown, a center conductor 997 of an associated coaxial cable 995 is also engaged with the splice second end accessible contact 918.

FIGS. 10A and 10B show cross sectional views of a single ended female coaxial connector 1000A, 1000B. A connector body 802 having first and second ends 808, 810 houses a stationery contact assembly 804 with a stationery contact 805, and a movable contact assembly 806 with a movable contact 807. As seen, a connector body central conductor incorporates contacts of the stationery and movable contact assemblies. Supporting the connector body is a connector base 1022 that is fixed to the body's first end 808.

A first bore of the body 1019 receives the stationery contact assembly 804 and a second bore of the body 1021 receives the movable contact assembly 806. In various embodiments the bores 1019, 1021 have similar or the same diameters and in some embodiments the bore is a single bore.

The stationery contact assembly 804 has a generally tubular shape and is fitted into the first body bore 1019. The contact assembly includes a stationery conductor 1026 and a stationery conductor carrier 1008.

A first end of the carrier 1081 is positioned near the first end of the body 808 and a second end of the carrier 1061 extends into the body. A socket of the carrier 1066 holds the conductor 1026. The conductor 1026 extends through the carrier end 1081 and through a connector base passageway 1033. The conductor's body enclosed end is the stationery contact 805.

The movable contact assembly 806 has a generally tubular shape and is fitted into the second body bore 1021. The movable contact assembly includes a movable conductor assembly 942 and a movable conductor assembly carrier 982.

A first end of the carrier 983 protrudes from the body 802 and a second end of the carrier 962 extends into the body. A socket of the carrier 968 holds the conductor assembly 942. The conductor assembly 942 extends between and includes the movable contact 807 at one end and an accessible contact 918 with inwardly directed tines 958 at an opposed end. A movable entrance of the carrier 935 provides access to the accessible contact.

In various embodiments, the movable contact assembly 806 is separated from the stationery contact assembly 804 by a resilient device or material such as a spring. In an embodiment, a coil spring 902 is captured between an end of the movable carrier 988 and fixed surface such as a radial shoulder of the stationery carrier 1086. As skilled artisans will recognize, the function of springing the stationery and movable contact assemblies apart can be accomplished in other ways with similar effect. For example, the contact assemblies may interoperate via telescoping arrangement as shown or they may have no such engagement.

A feature of this connector is seen in FIGS. 10A and 10B. In particular, engaging a mating connector 999 with the second end of the single ended female connector 810 pushes a protruding nose 960 of the first contact assembly toward the first end of the body 808. Moving with the contact assembly is the movable contact 807 which is seen in FIG. 10B to engage the stationery contact 805 by traversing a gap 1041. This completes the circuit between the accessible contacts 918 and the stationery conductor 1026. As shown, a center conductor 997 of an associated coaxial cable 995 is also engaged with the connector second end accessible contact 918.

As skilled artisans will recognize, contact arrangements shown in FIGS. 9-10 are changed in different embodiments. For example, other contact arrangements include single piece male and female contacts such as pancake contacts, female binary contacts such as knife switch like female contacts, and other switch contact arrangements that will be appreciated by skilled artisans as suitable for this application(s).

FIGS. 11A-C show cross sectional views of a crimp type male coaxial cable connector utilizing a fixed pin 1100A-C. As persons of ordinary skill in the art will understand, the described movable and stationery contact assemblies may be implemented in other connectors including other male F type connectors having different structures for cable fixation.

FIG. 11A shows the connector before a coaxial cable is inserted 1100A. A connector body 802 extends between first and second connector ends 808, 810 and a fastener 809 engages the second connector end. Near the first end of the connector is a crimp portion of the connector 1162. The connector body houses a stationery contact assembly 804 with a stationery contact 805 (coaxial cable center conductor see FIG. 11A, B) and a movable contact assembly 806 with a movable contact 807. As seen, a connector body central conductor incorporates contacts of the stationery and movable contact assemblies.

A first bore of the body 1119 receives the stationery contact assembly 804 and a second bore of the body 1121 receives the movable contact assembly 806. In various embodiments, the bores 1119, 1121 have similar or the same diameters and in some embodiments the bore is a single bore.

FIG. 11B shows the connector after a coaxial cable is inserted 1100B. The stationery contact assembly 804 has a generally tubular shape and is fitted into the first body bore 1019. The coaxial cable 995 is stabbed onto a hollow post 1132 such that the post passes between a cable shielding braid 1175 and a cable dielectric 1176. An annular collar 1170 is inserted in a mouth of the post 1129 near the body's second end 810. The collar aperture 1174 is a passageway through which the coaxial center conductor 1171 passes. This free end of the coaxial cable center conductor is the stationery contact 805.

The movable contact assembly 806 has a generally tubular shape and is fitted into the second body bore 1121. This contact assembly includes a movable contact carrier 1178, the movable contact 807, and an elongated pin 1180. The pin is electrically coupled to the movable contact and fixed to the carrier such that it projects beyond a fastener mouth 1181.

A first end of the movable carrier 1183 protrudes from the body 802 and the second end of the carrier 1184 extends into the body. A socket of the carrier 1168 holds the movable contact 807 and the elongated pin 1180.

In various embodiments, the movable contact assembly 806 is separated from the stationery contact assembly 804 by a resilient device or material such as a spring. In an embodiment, a coil spring 1102 is captured between an end of the movable carrier 1184 and a fixed surface such as a part of the stationery contact assembly 804. As skilled artisans will recognize, the function of springing the stationery and movable contact assemblies apart can be accomplished in other ways with similar effect. For example, the contact assemblies may interoperate via telescoping arrangement as shown or they may have no such engagement.

A feature of this connector is seen in FIGS. 11A-C. In particular, engaging a mating connector such as a female connector or splice end 1100C with the second end of the fixed pin connector 810 pushes a protruding nose 1160 of the first contact assembly toward the first end of the body 808 while compressing the coil spring 1103. Moving with the contact assembly is the movable contact 807 which is seen in FIG. 11C to engage the stationery contact 805 by traversing a gap 1141. This completes the circuit between the center conductor of the coaxial cable 1171 and the elongated pin 1180. Note, the coaxial cable 995 is not shown in FIG. 11C for clarity.

Embodiments of the invention are configured as adapters for use with existing coaxial connector connectors. For example, panel mounted coaxial connector ports can be protected against RF ingress using embodiments of the invention such as the adapter discussed below.

FIG. 12 shows a cross sectional view of an adapter 1200. A connector body 802 having first and second ends 808, 810 houses a stationery contact assembly 804 with a stationery contact 805, and a movable contact assembly 806 with a movable contact 807. As seen, a connector body central conductor incorporates contacts of the stationery and movable contact assemblies. At the first end of the connector is a fastener such as an internally threaded fastener 1209.

A first bore of the body 1219 receives the stationery contact assembly 804 and a second bore of the body 1221 receives the movable contact assembly 806. In various embodiments, the bores 1219, 1221 have similar or the same diameters and in some embodiments the bore is a single bore.

The stationery contact assembly 804 has a generally tubular shape and is fitted into the first body bore 1219. The contact assembly includes a stationery conductor 1226 and a stationery conductor carrier 1208.

A first end of the carrier 1281 is positioned near the first end of the body 808 and a second end of the carrier 1261 extends into the body. A socket of the carrier 1266 holds the conductor 1226. The conductor 1226 extends through the carrier end 1281 and in some embodiments through a connector body annular end wall 1293. The stationery conductor's enclosed end is the stationery contact 805.

The movable contact assembly 806 has a generally tubular shape and is fitted into the second body bore 1221. The movable contact assembly includes a movable conductor assembly 1242 and a movable conductor assembly carrier 1282.

A first end of the carrier 1283 protrudes from the body 802 and a second end of the carrier 1262 extends into the body. A socket of the carrier 1268 holds the conductor assembly 1242. The conductor assembly 1242 extends between and includes a) the movable contact 807 with inwardly directed tines 1257 at one end and b) an accessible contact 1218 with inwardly directed tines 1258 at an opposed end. A movable entrance of the carrier 1235 provides access to the accessible contact.

In various embodiments, the movable contact assembly 806 is separated from the stationery contact assembly 804 by a resilient device or material such as a spring. In an embodiment, a coil spring 1202 is captured between an end of the movable carrier 1288 and fixed surface such as a radial shoulder of the stationery carrier 1286. As skilled artisans will recognize, the function of springing the stationery and movable contact assemblies apart can be accomplished in other ways with similar effect. For example, the contact assemblies may interoperate via telescoping arrangement as shown or they may have no such engagement.

Comparing this connector with the connector of FIGS. 10A and 10B illustrates a feature of this connector. In particular, engaging a mating connector 999 with the second end of the adapter 810 pushes a protruding nose 1260 of the first contact assembly toward the first end of the body 802. Moving with the contact assembly is the movable contact 807 which engages the stationery contact 805 by traversing a gap 1241. This completes the circuit between the accessible contacts 1218 and the stationery conductor 1026.

FIGS. 13A and 13B show a second coaxial splice connector 1300A, 1300B. This connector is similar to the connector of FIGS. 9A and 9B and implements a disconnect switch including stationery and movable contact assemblies 940, 942. In addition, this connector implements a second shield using a retractable coaxial shield assembly 1399.

The movable contact assembly 806 has a generally tubular shape and is fitted into a second bore of the body 921. The movable contact assembly includes the movable conductor assembly 942 and a movable conductor assembly carrier 1382. Adjacent to a first end of the carrier 1383 is a generally tubular nose 1310 protruding from the body 802. A second end of the carrier 1362 has a generally tubular shape and is separated from the nose by a reduced diameter waist 1313. The waist is, in various embodiments, made from one more materials including an insulating material(s).

Portions of the retractable coaxial shield assembly 1399 are formed by a coaxial shield spring such as a normally closed coaxial shield spring 1316 and the movable conductor assembly carrier 806. In various embodiments, the spring shield encircles one or both of the movable conductor assembly carrier 1382 and the conductor of the movable contact assembly 942. Details of this spring are shown in detail views 1350 and 1354. In particular, detail view 1350 shows the shield spring has a collar 1351 adjoining inwardly pointed fingers 1353 with finger tips 1355. Detail view 1354 shows a view of the shield spring looking into the open collar end of the spring.

In various embodiments, the shield spring 1316 is mounted such that its fingers 1353 are moved and/or lifted up by movement of the conductor carrier nose 1310 toward the first end of the connector 808. With the nose in an extended position, the spring finger tips 1355 are initially at rest against an outer surface of the waist 1322. As the nose is pushed into the body, a shoulder of the movable contact assembly near the waist 1312 lifts the spring fingers out of a space above the waist 1318 and toward an inner surface of the body 1317. In similar fashion, as the movable contact assembly returns to its earlier extended position, the spring fingers descend toward the waist until the finger tips rest on the waist outer surface.

In some embodiments, the shield spring collar 1351 encircles and touches the nose outer surface 1330. And, in some embodiments the shield spring collar encircles the nose outer surface but does not touch the outer nose surface. In connector embodiments utilizing an annular end plug 1387, the shield spring collar, encircles the plug in some embodiments while in others it lies at least partially within the plug.

Because the shield spring 1316 is an energy shunt, it is electrically conductive and there is electrical continuity between the shield spring and the body 802. In addition, the distance between the movable conductor assembly 942 and the deployed finger tips of the shield spring 1355 as determined by a waist thickness is, in various embodiments, in the range of about 0.2 to 1.0 millimeters and in an embodiment about 0.5 millimeters. This separation distance or waste thickness is chosen to promote antenna like action of the spring shield with respect to the movable conductor assembly.

A feature of this connector is seen in FIGS. 13A and 13B. In particular, engaging a mating connector 999 with the second end of the splice 810 pushes a protruding nose 1310 of the movable contact assembly 806 toward the first end of the splice body 808. Moving with the movable contact assembly is the movable contact 807 which is seen to engage the stationery contact 805 by traversing a gap 1341. This completes the circuit between the accessible contacts 916 and 918 of the splice. A center conductor 997 of an associated coaxial cable 995 is also engaged with the splice second end accessible contact 918. Further, as explained above, the retractable coaxial shield 1316 is deployed while the protruding nose is extended and lifted away from the movable conductor assembly 942 when the protruding nose is pushed toward the connector's first end 808.

Embodiments utilizing a retractable coaxial shield spring need not incorporate a disconnect switch. For example, FIGS. 14A and 14B show a third coaxial splice connector 1400A, 1400B. Like the connector of FIG. 13A above, this third splice connector incorporates a retractable coaxial shield spring. However, it does not include a disconnect switch.

The connector body 1402 extends between first and second ends 1408, 1410 and includes a seizing pin 1404 supported at the first end by a stationery carrier 1460 located in a first bore of the body 1419 and supported at the second end by a movable carrier 1462 located in a second bore of the body 1421.

First and second contacts of the seizing pin 1417, 1418 are inserted in opposed ends 1464, 1466 of through holes in the stationery and movable carriers 1463, 1465. The seizing pin contact in the movable carrier 1418 is slidable in the through hole 1465 and is acted on by a spring 1420. One end of the spring presses on an annular face of the movable contact face 1426. Another end of the spring presses on an inwardly turned shoulder at a mouth of the movable carrier through hole mouth 1424. Action of the spring tends to hold a movable carrier rim 1439 against an inwardly turned shoulder at a mouth of the body 1437.

RF shielding is provided by a coaxial shield spring such as a normally open coaxial shield spring. An embodiment of this spring is shown in views marked 1450 and 1454. In particular, view 1450 shows a shield spring has a collar 1451 adjoining outwardly pointed fingers such as flared fingers 1453 with finger tips 1455. Detail view 1454 shows a view of the shield spring looking into the open collar end of the spring.

In various embodiments, the shield spring 1450 is mounted such that its fingers 1453 are extended radially outward when a carrier nose 1411 is extended. When the nose is pressed into the body 1402, it slides along the seizing pin and captures the shield spring fingers between the seizing pin and the bore of the movable carrier 1465. In various embodiments, the shield spring collar is fixed with respect to the seizing pin such as by soldering, by collar mechanical features that interengage with seizing pin mechanical features, and the like.

As with the first coaxial shielding spring of FIG. 13A, this second coaxial shielding spring is also electrically conductive. FIG. 14A shows the shielding spring deployed and establishing electrical continuity between the conductive connector body 1402 and the seizing pin 1404. FIG. 14B shows the shielding spring in a stored position alongside the seizing pin.

FIGS. 14C and 14D show a different embodiment 1400C, 1400D utilizing a coaxial spring. In FIG. 14C, the F-Type connector for splicing coaxial cables terminated with male connectors is shown before it is mated with a male connector. In FIG. 14D, the splicing connector is shown mated with a mated male connector.

In this embodiment, an electrical resistance is inserted in a circuit between the seizing pin 1404 and the connector body 1402. For example, a retractable coaxial spring shown in views 1480 and 1484 is designed to insert a fixed resistance, such as a nominal 75 or 50 ohm resistance, in the circuit including the spring that selectively electrically couples the seizing pin 1404 and the connector body 1402. In particular, the resistance is inserted when the carrier nose 1411 extends from the body prior to being mated with a male connector such that the spring fingers extend to the connector body. As explained above, a mated male connector that pushes the carrier nose 1411 within the body causes the spring fingers to be drawn away from the connector body which opens the circuit between the seizing pin and the connector body.

Resistors may be implemented in a various ways. For example, FIG. 14C shows spring finger tips 1490 that include resistors. Here, one or more finger tips include a resistor while electrically conducting fingers, if any, that would otherwise touch the body inner surface 1440 are prevented from shorting across the resistor by, for example, electrically insulating these non-resistive tips. In an embodiment, two finger tips 1490 include resistors (as shown). Here, there may be only two fingers or more than two fingers. To the extent there are more than two conductive fingers that would otherwise touch the body inner surface, these fingers are insulated to avoid a short circuit across the resistors.

In another embodiment, a peripheral resistor such as a resistive coating or a resistive sleeve separates spring fingers 1496 from the connector body. For example, a resistive sleeve inserted in the connector body may expose a sleeve inner surface 1440 for contact with spring fingers. In yet another embodiment, the coaxial spring material is designed to provide the desired resistance in the circuit between the seizing pin 1404 and the connector body 1402.

Resistor construction may be by any suitable method known to persons of ordinary skill in the art such as resistive films, structures, and/or coatings. For example, film type resistors such as thick and thin film resistors using carbon or metal film may be used.

In some embodiments, a resistive circuit similar to the one described above is implemented in a male connector. See for example the optional resistor 1179 extending between the moveable contact 807 and the body 802 of the male connector of FIG. 11B when the nose 1160 is extended prior to mating a female connector. As will be appreciated by persons of ordinary skill in the art, prior to mating the resistive circuit is coupled between the contact and the body while after mating the resistive circuit is not coupled between the contact and the body.

As skilled artisans will recognize, contact arrangements shown above are changed in different embodiments. FIGS. 9A, 10A, 12, and 13A are examples where at least some contacts can be reversed. In particular, the stationery contact 805 shown in FIG. 10A is a male contact while the movable contact 807 of the same FIG. is a female contact; these contacts may be reversed such that the stationery contact is a female contact and the movable contact is a male contact.

FIG. 15 compares RF passing through open coaxial splices 1500. In particular, in a frequency range of 0.3 MHz to 1000 MHz, a prior art splice similar to the splice of FIG. 3A allows the RF ingress shown by trace 1506, an estimated −70 dB signal on average 1503. In the same frequency range, a splice similar to the inventive embodiment of FIG. 9A allows RF ingress shown by trace 1502, a signal generally below −110 dB 1504. As can be seen, a −40 dB improvement results from use of such a splice.

FIGS. 16-18 show another embodiment of the present invention. In particular, FIG. 16 shows a female coaxial connector assembly 1600. As shown, the coaxial connector 1604 is held by a structure such as a bulkhead structure 1602. In some embodiments, the connector is integral with the structure (as shown).

The connector 1604 includes a connector body 1605 with first and second connection interfaces 1608, 1610. The first connection interface is a female connector end or front end 1608 for engaging a male connector (not shown). In some embodiments, the female end is threaded 1606 to engage the nut of a mating connector such as the nut of a male F-type coaxial cable connector. The second connection interface is generally opposite the first connection interface and provides an electrical coupling means such as a terminal 1758 at a connector rear end.

A contact assembly 1700 is housed by the connector body 1605. As seen in FIGS. 16-18 and as further explained below, a connector body central conductor incorporates portions of the contact assembly. In various embodiments, this contact assembly is supported from the connector body by one or more supports. In the embodiment shown, first, second, and third supports 1612, 1614, 1616 serve this function.

The first support 1612 is located at the female/front of the connector 1608 and the third support 1616 is located at the rear end of the connector 1610. Between the first and third supports is the second support 1614. Each of the supports has a central hole 1642, 1644, 1646 in which the contact assembly 1700 is inserted and a periphery of each of the supports 1652, 1654, 1656 is supported by a respective inside surface of the connector body 1662, 1664, 1666. In some embodiments the supports have an annular shape and, in some embodiments the connector body inside surfaces are in the form of bores of one or more diameters. And, in some embodiments where the inside surfaces are in the form of bores, a central inside surface of the connector body between the second and third supports 1620 has a diameter about equal to that of the third inside surface 1666 and less than that of the second inside surface 1664.

One or more parts of the contact assembly 1700 are positioned along a connector body axis x-x and relative to the connector body 1605 by one or more supports. In various embodiments, supports, such as any of the first, second and third supports 1612, 1614, 1616 serve this function. And, in some embodiments, shoulders of one or more supports serve this function. In one example, a shoulder of the second support 1669 supports a contact assembly rim 1670. In another example, the third support has first and second intersecting bores 1646, 1648 creating an inwardly extending rim 1674 that engages a stationery contact shoulder 1672. As shown, both of the second and third supports are used to position the contact assembly within the body.

As illustrated by FIGS. 16-18, embodiments of the contact assembly 1600, 1700, 1800 include moving parts and stationery parts. In particular, moving parts include the movable contact 1720 and stationery parts include the stationery contact 1730.

The movable contact 1720 has a socket 1722 at one end and an insertion pin 1726 at a generally opposed end. In various embodiments, a spring such as a coil spring 1728 surrounds the insertion pin. A socket mouth 1723 provides access to the socket. Between the socket mouth and the insertion pin are feature(s) of the movable contact for guiding, fixing, and/or supporting the movable contact. For example, the movable contact rim 1670 discussed above provides support via engagement with the second support 1614. In various embodiments a peripheral movable contact stop shoulder 1724 limits an axial stroke of the movable contact assembly. And, in various embodiments a spring shoulder adjacent to the insertion pin 1754 provides a first spring rest for a first spring end 1761. As seen here, the first spring rest moves with the movable contact. And, as seen below, a second and generally opposed second spring rest for the second spring end 1763 does not move with the movable contact.

Means for holding a female contact is provided by the movable contact socket 1720. Suitable female contacts 1712 include single-ended female contacts with a female contact mouth 1714 and inwardly directed tines 1713, or similar dual-ended female contacts (as shown). In various embodiments, a socket endcap 1710 has an endcap mouth 1711 such that when the endcap is fitted over the socket, a center conductor of a coaxial cable is insertable via the endcap mouth into the female contact mouth and tines for establishing electrical continuity between the conductor and the movable contact. In FIG. 16, an endcap 1710 is shown slidably engaging and protruding from the central hole 1642 in the first support 1612.

The stationery contact 1730 provides a mating contact for the movable contact at one end and at the other end is a connection terminal 1758. In various embodiments, the stationery insertion pin receiver 1736 has a mouth 1737 facing the insertion pin 1726. Tending to push the stationery contact and movable contact 1720 apart is the spring 1728 interposed between the two.

In various embodiments, the stationery contact 1730 and the spring 1728 are separated by an electrical insulator. For example, where the spring would otherwise provide an unwanted current path between the movable contact 1720 and stationery contact, electrical isolation may be used. Isolation may take various forms including an insulator such as non-conducting plastic washer used as the second spring rest or a non-conducting plastic sleeve with a rimmed end serving as the second spring rest. As shown, a non-conducting spring sleeve 1732 has a rimmed end 1756 abutting the stationery contact insertion pin receiver end 1737. Here, the spring is inserted in a spring sleeve mouth 1734 such that the sleeve's rimmed end 1756 provides the second spring rest.

In typical embodiments, the connector body 1605 is made from an electrical conductor such as a suitable metal. Here, the connector body and the contact assembly 1700 typically provide isolated current paths. Generally, the movable and stationery contacts 1710, 1730 are isolated from the connector body. In some embodiments, stationery contact isolation from the connector body is provided by an insulating third support. And, in some embodiments the movable contact 1720 is isolated from the connector body by an insulating second support 1614 and by one of an insulating first support 1612 and an insulating endcap 1710. Insulating supports may be made from any suitable electrical insulator such as a suitable non-conducting plastic, for example a non-conducting polyvinylchloride material. In light of the present disclosure, other insulation schemes will be obvious to persons of ordinary skill in the art.

When the contact assembly 1700 is assembled within the connector body 1605 as shown in FIG. 16, the movable contact 1720 is operable to complete an electric current path between the movable contact and the stationery contact 1730.

In particular, when a male coaxial connector with a center conductor (such as an F-Type male connector, not shown) engages the front/female end of the inventive connector 1608: (1) the male connector center conductor passes through the endcap mouth 1711 and is inserted into the female contact mouth 1714 and tines 1713, establishing electrical continuity between the conductor and the movable contact; (2) as the gap between the male and female connectors is closed, for example by tightening a male connector threaded nut onto mating threads of the female connector 1606, the endcap 1710 is pushed toward the spring 1728; (3) when the endcap moves toward and compresses the spring, the movable contact 1720 is pushed toward the stationary contact 1730 and the movable contact insertion pin 1726 engages the stationery contact insertion pin receiver 1736; and (4) when the movable contact insertion pin and stationery contact insertion pin receiver are engaged, electrical continuity is established between the center conductor of the male connector and the connector rear terminal 1758.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A shielded F type coaxial connector comprising:

a connector body housing a center conductor;

a switch within the body that is electrically isolated from the body;

the switch operable to open a circuit that includes the center conductor;

wherein the switch is a series switch comprising a plurality of switch contacts arranged along a centerline of the connector body; and, a spring encircling a stationery contact assembly.

2. A shielded F type coaxial connector comprising:

a connector body housing a center conductor;

a mechanically actuated radio frequency interference shield within the connector body;

a shield actuator protruding from the body;

a normally closed shield spring encircling the center conductor;

an insulating medium interposed between a plurality of shield spring finger tips and the center conductor; and, action of the shield spring actuator operative to move the shield spring finger tips away from the center conductor.

3. The shielded coaxial connector of claim 2 further comprising;

a normally open shield spring encircling the center conductor;

a plurality of shield spring finger tips engaging an inside of the body; and, action of the shield spring actuator operative to move the shield spring finger tips away from the inside of the body.

4. The connector of claim 3 further comprising:

a stationery contact assembly including stationery contact;

a movable contact assembly including a movable contact; and, the relative position of the contacts changing with an overall length of the connector.

5. The connector of claim 4 further comprising:

a shield spring actuator configuration operable to engage the movable and stationery contacts when the shield spring actuator is pushed toward the body end.

6. The connector of claim 5 wherein the movable contact assembly includes a female contact for receiving a center conductor of a coaxial cable.

7. The connector of claim 5 wherein the movable contact assembly includes a male contact for engaging a mating coaxial connector.

8. The connector of claim 5 wherein the movable contact assembly includes the shield spring actuator.

9. A shielded coaxial cable connector comprising:

a contact assembly including a movable contact and a stationery contact;

a connector housing for supporting the contact assembly;

the movable contact having a female contact for receiving a center conductor of a coaxial cable, the female contact electrically coupled to a first switch contact;

the stationery contact having a second switch contact electrically coupled to a terminal;

a movable contact actuator extending from the connector housing and a spring tending to hold the switch contacts apart; and, wherein the spring is compressed and the switch contacts are brought together when a male connector being mated with the shielded coaxial connector pushes on the movable contact actuator.

10. The shielded coaxial cable connector of claim 9 further comprising:

first and second spring rests for supporting first and second ends of the spring;

the first spring rest located on the movable contact; and, the second spring rest located between the switch contacts.

11. The shielded coaxial cable connector of claim 9 further comprising:

a first spring rest in the form of a peripheral shoulder of the movable contact; and, wherein the movable contact extends through the spring when the contacts are brought together.

12. The shielded coaxial cable connector of claim 11 further comprising:

a contact assembly insulator between the second switch contact and the spring second end; and, the insulator providing a second spring rest.

13. The shielded coaxial cable connector of claim 12 further comprising:

an insertion pin of the first switch contact;

an insertion pin receiver of the second switch contact; and, wherein electrical continuity between the movable and stationery contacts is established when the insertion pin is fitted in the insertion pin receiver.

14. The shielded coaxial cable connector of claim 13 further comprising a spring sleeve that incorporates the contact assembly insulator.

15. A shielded F type coaxial connector comprising:

a connector body housing a center conductor;

a shield actuator protruding from the body;

a normally open shield spring encircling the center conductor;

a shunting circuit including the spring and a 75 ohm resistor;

action of the shield spring actuator is operative to move the shield spring fingers away from the inside of the body and to open the shunting circuit; and, wherein the shunting circuit is for electrically connecting the center conductor and the body.

16. The connector of claim 15 wherein the resistor is located between the body and the spring.

17. The connector of claim 15 wherein the resistor is integral with the body.

18. The connector of claim 15 wherein the resistor is integral with the spring.

19. A shielded F type coaxial connector comprising:

a connector body housing a center conductor;

a series switch within the body that is electrically isolated from the body;

a 75 ohm resistor electrically coupling the center conductor and the body only when the switch is open; and, the switch operable to disconnect a first end of the center conductor from a second end of the center conductor.

* * * * *